United States Patent [19]

Hyatt et al.

[11] 4,226,575

[45] Oct. 7, 1980

[54] WET PICK-UP VACUUM UNIT

[75] Inventors: Robert L. Hyatt, Tallmadge; Norbert H. Niessner, South Euclid; Richard D. Sumser, Louisville, all of Ohio

[73] Assignee: Ametek, Inc., Kent, Ohio

[21] Appl. No.: 46,007

[22] Filed: Jun. 6, 1979

[51] Int. Cl.[3] ..... F04B 37/20

[52] U.S. Cl. ..... 417/423 A; 415/112; 417/368

[58] Field of Search ..... 417/368, 423, 424; 415/110–113

[56] References Cited

U.S. PATENT DOCUMENTS

| | | | |
|---|---|---|---|
| 3,733,150 | 5/1973 | Porter et al. | 417/424 |
| 3,932,070 | 1/1976 | Porter et al. | 417/423 A |
| 4,088,424 | 5/1978 | Hyatt et al. | 417/368 |

*Primary Examiner*—Edward L. Roberts

*Attorney, Agent, or Firm*—Albert L. Ely, Jr.

[57] ABSTRACT

A motor-fan unit for a wet pick-up type of vacuum cleaner comprising a fan-section and a separately ventilated motor section. A motor-end bracket in the motor housing structure serves as a common end wall with the fan section and carries a bearing for the common shaft of the motor and fan. A baffle carried by the motor-end bracket within the fan section has an apertured central portion, at least partly enclosing the bearing, to provide a passage-way for high velocity air sealing the bearing from detergent-containing cleaning liquid entrained in working air drawn into the fan section. A normally closed check valve at an inlet to the sealing air passage-way inhibits back-flow of either air or liquid through the inlet but permits such sealing air to serve as cooling air when the entrance of working air into the fan section is impeded.

15 Claims, 3 Drawing Figures

WET PICK-UP VACUUM UNIT

SUMMARY OF THE INVENTION

This invention relates to motor-fan units for "wet pick-up" vacuum cleaners; that is, vacuum cleaners for floors, rugs, and carpets which are still wet with residual water or a water-detergent solution used for cleaning and scrubbing. More particularly, the invention provides improvements upon units disclosed in the patent granted to two of us, namely, U.S. Pat. No. 4,088,424, granted May 9, 1978, to Robert L. Hyatt and Norbert H. Niessner for "Wet Pick-Up Vacuum Unit Motor Bearing Air Seal". Said patent constitutes the closest prior art of which we are aware.

An object and advantage of this invention is that it not only provides a simplified structure for effecting the air-seal by which auxiliary (non-working) air drawn into the fan section protects the fan bearing from attack by detergent entrained in the working air which is drawn into and discharged from the fan section, but such structures also permit either a higher velocity of air at the air seal—thereby increasing the effectiveness of the seal—and/or enables the use of an auxiliary fan having smaller blades (and thus smaller capacity)—thereby decreasing the consumption of power attributable to the operation of the auxiliary fan.

Another object and advantage of this invention is that it eliminates a possibility of back-flow through an inlet for the sealing air and the eventual seepage into the motor of cleaning liquid. Such seepage could occur when there is an improper location of the motor-fan unit by a manufacturer of cleaning equipment utilizing such a unit or when there has been mis-use or mis-handling by the user of such equipment as by allowing a blockage of the discharge of working air and its still entrained liquid from the fan section or by tipping over the equipment so that liquid, normally collected in a separate canister before the working air enters the fan section, may drain into the fan section and then out through the inlet for the sealing air.

A still further advantage of the invention is that the means for eliminating such back-flow also permits the auxiliary bearing-sealing air to function as cooling air preventing overheating of the fan elements and the bearing if an insufficient amount of working air is drawn into and delivered from the fan section.

Other and further objects and advantages of this invention will be apparent to those skilled in the art from the following detailed description of an embodiment of this invention, claims, and drawings, in which:

DETAILED DESCRIPTION

Figure 1:
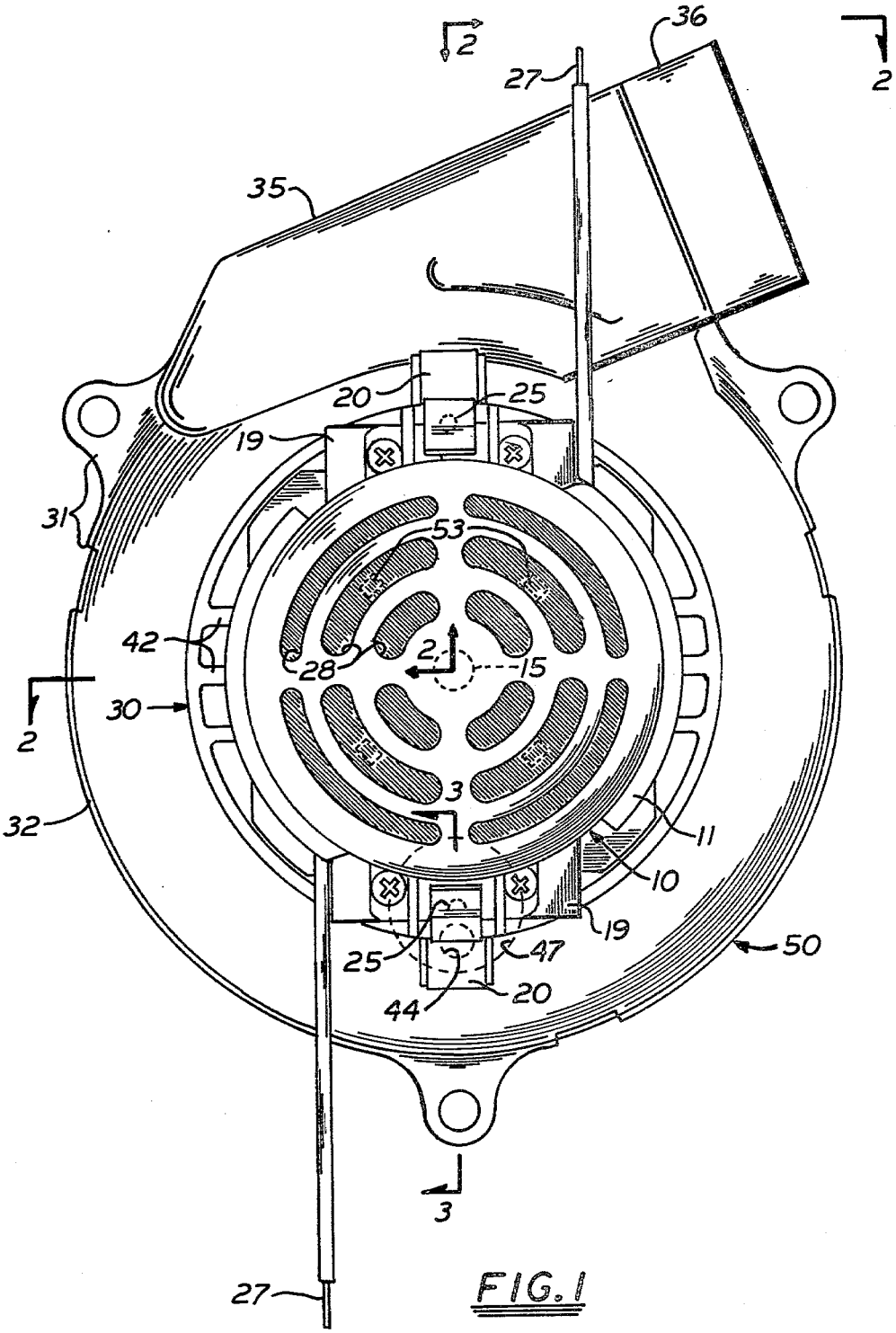
FIG. 1 is an elevation constituting an end view, taken at the motor end, of a motor-fan unit made according to this invention.

Referring to the drawings, a motor-fan unit made according to this invention is comprised of a motor section 10 and a fan section 50. Except for its fan-end bracket designated by the general reference number 30 and described in greater detail below, the motor and frame of the motor section 10 may be of any suitable conventional construction.

MOTOR SECTION

In the particular embodiment shown, the motor section 10 comprises a brush-end housing 11 molded of a suitable plastic of high impact strength and rigidity. (It is to be understood that any structural elements of the motor section which are stated or shown in the drawings to be of a molded plastic may, instead, be of die-cast or other conveniently formed metal; similarly, in the fan section 50, structural elements stated or shown as being of metal may be of plastic when parts of the latter material, if of suitable strength and durability, may be more economically produced.) The brush-end housing 11 carries a central bearing socket 12 supported from the inner wall of the housing by means of a spider structure 13. A bearing 14, suitably supported in the socket 12, has journaled therein the common single shaft 15 for the motor armature 16 and commutator 17 (both shown diagrammatically) as well as the several fans thereon and driven thereby. One of these fans is the motor ventilating fan 18 mounted on the end of the shaft 15 extending outboard of the bearing 14.

Figure 3:
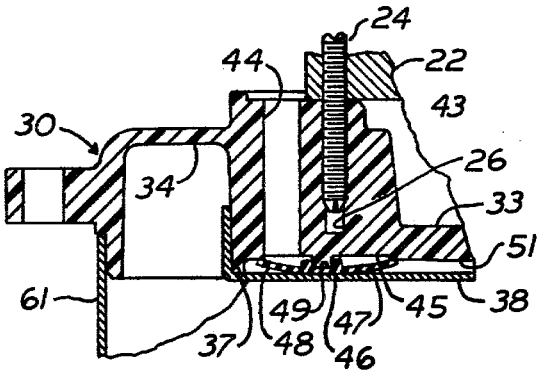
FIG. 3 is an enlarged detailed section taken along the line 3—3 of FIG. 1.

The brush end housing 11 is formed with a pair of opposite bosses 19 to which a pair of brush assemblies 20 are fastened. These bosses 19 and integral spacers 21 bear upon the motor field iron 22 (of which the laminations are not shown for simplicity of illustration) while otherwise spacing the open end of the brush-end housing 11 from the field iron 22. Before the brush assemblies 20 are fastened on the bosses 19, the armature 16 and its commutator 17 are assembled on the shaft 15, which is then inserted in the main bearing 40 of the unit while the assembled brush-end housing 11 and the field 22, with its field coils 23, are assembled on the fan-end bracket 30. This assembly is secured by a pair of self-tapping through-bolts 24 (the heads 25 of which are normally concealed beneath the brush assemblies 20). Such through-bolts 24 extend through the bosses 19, the field 22, and are held in the holes 26 drilled or molded in the fan-end bracket 30 (see FIG. 3). With the brush assemblies 20 mounted and the motor suitably connected to the conductors 27 for either series or shunt operation of the motor, as desired, the motor section 10 is completed and ready for operation.

During operation the rotating motor ventilating fan 18 draws air through a suitable grid of openings 28 in the transverse end of the brush-end housing 11 (see FIG. 1) and discharges such to the ambient atmosphere through the several openings 29 provided by slits in the side of the housing 11 and the spacing of the housing 11 from the field iron 22. Such motor ventilating air thereby removes heat from the sources therefor which are otherwise enclosed in the brush-end housing 11, principally the commutator 17 and its associated brushes and ends of the field coils 23 and armature 16 as well as the field iron 22 which the motor-ventilating air contacts as it is driven through the housing 11 and out of the openings 29.

FAN SECTION

As explained in the aforesaid patent, motor-fan units (for which this invention constitutes an improvement) are suitable for various types of cleaning equipment for, but not necessarily restricted to, floors and coverings therefor, such as rugs and carpets. Such cleaning equipment operates by causing a residual cleaning liquid to be picked-up from the surface being cleaned. Such cleaning liquid is usually a dilute aqueous solution or dispersion of a detergent and, when picked up, is "dirty" due to soil which is suspended and/or dissolved in the cleaning liquid.

The cleaning equipment for which such units are adapted may be of various constructions, styles, and arrangements selected by the equipment manufacturers and over which the manufacturer of the motor-fan units, as such, may have no control. In general, however, such cleaning equipment comprises a relatively large canister or vessel (not shown) serving as a plenum chamber into the upper portion of which the fan section of the unit opens. Either through a flexible hose or directly, the canister is connected to a pick-up nozzle which contacts the surface wetted with the residual cleaning liquid so that, by entrainment of the residual cleaning liquid in a relatively large volume of "working air" drawn at less than atmospheric pressure into the fan section of the motor-fan unit, the substantial majority of the liquid carried by the working air drops out of entrainment and is collected in the canister. Filters and baffles in the canister may aid gravity in effecting the separation of the entrained liquid from the working air. The collected soiled cleaning liquid may either be emptied from the canister as it becomes filled or may be continually drained. While the majority of the liquid is being separated from the working air, the latter is drawn into the fan section of the unit and discharged therefrom, usually through a flexible hose (not shown) leading to a suitable place for discharge of the working air.

(a) Fan-end bracket

The fan-end bracket 30 of the disclosed embodiment is preferably a generally cylindrical member provided with ears and notches 31 by which the entire unit may be fastened and indexed in the position selected for it by a manufacturer of vacuum cleaning or scrubbing equipment. The outer surface of the bracket 30 is preferably provided with raised shoulders 32 against which is seated the rim of the flanged casing 61 into which the bracket fits. Together with the bracket 30, the casing 61 defines the fan chamber 60 of the fan section 50.

The outer wall of the bracket 30 and the concentric flange of its inner wall 33 define a circular channel 34 which opens into the fan chamber 60. This channel 34 is interrupted for a portion of its outer periphery to provide an opening (not shown) into a tangential horn 35, preferably integrally molded with the bracket 30. The horn 35 preferably extends sufficiently beyond the outer wall of the bracket 30 to provide a terminal tubular portion 36 to receive a discharge hose for working air driven into the channel 34 by the fans in the fan chamber 60.

The flange of the inner wall 33 extends beyond the wall toward the fan chamber 60 to provide a shoulder 37 for a baffle plate 38 seated thereon and secured thereto, in this instance by a frictional fit between a flange on the baffle plate 38 and the portion of the inner wall 33 engaged thereby. The inner surface of the inner wall 33, itself and by its flange, define a central recess 39 opening into the motor section 10, the recess 39, thus providing a space which receives the portions of the field coils 23 and the armature 16 which extend toward the fan section 50. The flanged inner wall 33, therefor, serves as the common wall between the fan section 50 and the motor section 10 and through which extends the common shaft 15 for the above described rotating elements of the motor in the motor section 10 and for the several fans operating in the fan section 50. Accordingly, the center of the inner wall 33 is preferably molded with a relatively heavy support ring 41 recessed to receive the main bearing 40, in this instance a lubricated ball bearing carrying the radial load of the shaft 15.

The inner surface of the flange of the inner wall 33 is preferably formed with stiffening ribs 42 and bosses 43, upon the latter of which the field iron 22 bears and in which are provided the holes 26 for the self-tapping through-bolts 24.

Outboard of the through-bolts 24 and the portion of the surface upon which the field iron bears, at least one of the bosses 43 is provided with a sealing-air inlet 44. This inlet extends from the ambient atmosphere outside the motor section 10 through the boss 43 and the inner wall 33 to a slight depression 45 formed on the fan chamber side of the inner wall 33 within the shoulder 37 on the inner wall. At the center of this depression 45, a valve mounting stub 46 is formed to center a check valve 47 for the inlet 44.

In this particular embodiment, the baffle plate 38 is a shallow flanged cylindrical cup, providing a shallow cylindrical sealing air passageway 51 defined at its periphery by the shoulders 37 of the flanged inner wall 33. To accommodate so much of the support ring 41 as may extend toward the fan chamber 60 from the fan chamber side of the inner wall 33, the baffle plate 38 is offset at its center toward the fan chamber to maintain a spacing between the baffle plate and the ring 41 and the main bearing 40 retained therein. The baffle plate 38 need not necessarily be a cylindrical cup; so long as it provides a sealing air passageway leading from the check valve 47 for the inlet 44 to a sufficient space around the shaft 15, the baffle plate 38 may be rectangular, oval, or of any other suitable configuration.

The check valve 47 preferred in this embodiment is a so-called "mushroom" valve comprised of a slightly domed disk 48 of thin latex or other readily flexed elastomer molded on its concave surface with a centering socket 49 that may be press-fitted on centering stub 46. The thickness of the disk 48 at its center is such that, when mounted on the stub 46, its center is engaged against the baffle plate 38.

With no pressure differential across the disk 48, its diameter and domed configuration is such that its edge seats on the rim of the depression 45 so that the sealing air inlet is thereby normally closed.

Since the disk 48 is quite thin and flexible, only a slightly sub-atmospheric pressure on the convex side of the disk will raise the edge of the disk and permit air at atmospheric pressure at the inlet 44 to enter into a sealing air passageway 51 and then into the fan section 50. A function of the depression 45 is thus to distribute air from the inlet 44 so that the edge of the disk 48 is lifted around its whole periphery and the restriction of flow by the check valve is minimal as the disk 48 is held in its centered position on the stub 46 by the engagement of the center of the disk 48 with the baffle plate 38.

If the pressure within the passageway 51 should substantially exceed atmospheric, such pressure on the convex surface of the flexible disk could cause the normally domed disk 48 to reverse to a slightly cupped configuration. Another function of the depression 45, therefore, is to provide a rim against which the edge of the disk will continue to seat and seal in case super-atmospheric pressure on the normally convex surface of the disk should tend to cause such cupping.

The portion of the baffle plate 38 which provides sealing air passageway space over the bearing support ring 41 is provided an opening 52, which is substantially concentric with the shaft 15 and of a diameter which is usually approximately equal to that of the mean path of the balls in the main bearing 40. To prevent collapse of the baffle plate 38 and restriction of the passageway 51 in case of the possible development of substantially super-atmospheric pressure in the fan chamber 60, small support blocks 53 may be provided on the fan-chamber side of the inner wall 33.

(b) Fan Chamber

The deep-flanged casing 61, into which the fan-end bracket 30 is fitted to provide the fan chamber 60, has a central port 62 substantially concentric with the shaft 15. The area of the port 62 is selected to offer no substantial restriction to the flow of working air from the canister or plenum chamber of the cleaning equipment into the fan chamber 60 at the sub-atmospheric pressure and in the volume required by the cleaning equipment employing a motor-fan unit made according to this invention.

The fan chamber 60 encloses a plurality of fans, the one more nearly adjacent the main bearing 40 being a rotating centrifugal sealing air fan 63. This fan 63 is comprised of a plurality of relatively radially short blades 64 mounted on a disk 65, the latter having a central bore permitting the fan 63 to be mounted on the shaft 15. The disk 65 is in back-to-back relationship with a centrifugal working air fan 66 having radially longer blades 67 extending more nearly toward the flange of the casing 61, the blades 67 being carried in this instance by a disk 68 which also has a center bore permitting the fan 66 to be mounted on the shaft 15.

In the embodiment shown, the fan chamber 60 encloses not only the sealing air fan 63 and its adjacent working air fan 66 but additional fans for drawing working air into the fan chamber 60 in two stages (of which the fan 66 provides the second stage). Accordingly, the casing 61 is provided with an integral sub-casing 69 having a central opening 70 leading into the eye of the fan 66. The sub-casing 69 supports, radially outwardly of the opening 70, the radially extending fixed blades 71 of the intermediate "stationary fan" 72. The first stage fan 73 is comprised of blades 74 which extend radially nearly to the casing 61; these blades are carried by the disk 75 having a central bore permitting the fan 73 to be mounted on the shaft 15 and, thereby, locating the eye of the first stage fan 73 substantially concentrically with the port 62 in the casing 61.

Figure 2:
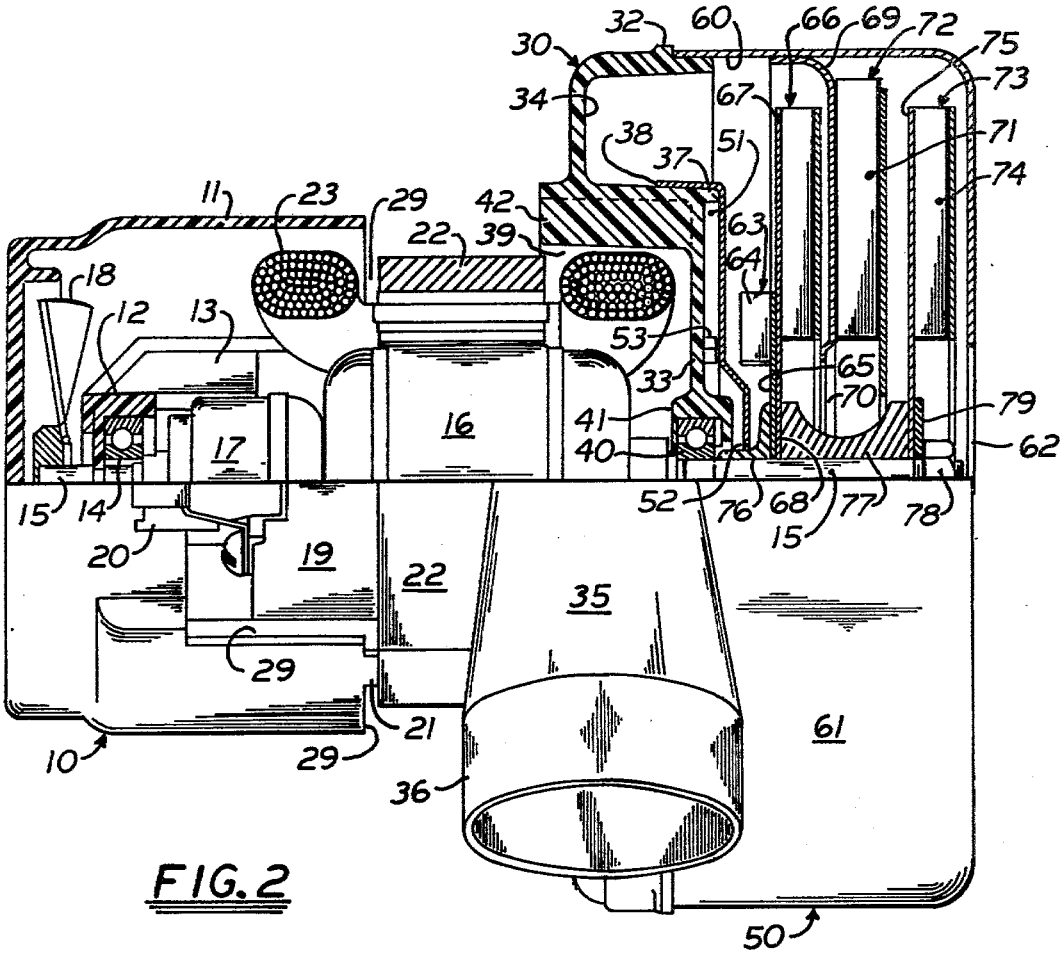
FIG. 2 is a side view of the unit shown in FIG. 1, but partly in section, as indicated by the line 2—2 of FIG. 1.

The rotated fans 63, 66, and 73 mounted on the shaft 15 may be driven thereby in any suitable manner. In this instance, the drive of the rotated fans is accomplished by means which permits their ready disassembly from the shaft 15 and a replacement of any one or more which may be damaged during use. Such drive means (see FIG. 2) comprises a first bushing or spacer 76 which extends inwardly through the central opening 52 in the baffle plate 38, and bears against the inner race of the main bearing 40, the spacer 76 preferably having an L-shaped cross-section to provide an enlarged transverse surface against which the disk 65 of the sealing air fan 63 may bear. Outwardly of the disk 68 of the second stage working air fan 66 is a second bushing or spacer 77 which extends through the opening 70 from the disk 68 of the fan 66 to the disk 75 of the first stage fan 73. In radial cross-section, the second spacer 77 preferably has an hour-glass configuration to provide a degree of a venturi effect as working air passes through the opening 70 from the intermediate "stationary fan" 71 to the second stage working air fan 66. Tightening and securing a nut 78, threaded on the outer end of the shaft 15, against a washer 79 bearing on the disk 75 thereby frictionally engages and clamps together the inner race of the main bearing 40, spacer 76, fan disks 65 and 68, spacer 77, fan disk 75 and washer 79 so that all turn as a unit with the shaft 15 as the latter is driven by the armature in the motor section 10.

Normal and abnormal operations; improvements and advantages of this invention

In normal operation, the rotating fans in the fan chamber 60 (all driven by the armature 16 which is also mounted on the common shaft 15) draw working air into the fan section 50 at a sub-atmospheric pressure ("vacuum") from the canister or plenum chamber of the cleaning equipment in which the motor-fan unit is mounted. Such working air is then discharged through the channel 34, horn 35, and a flexible hose usually connected thereto, at pressure which is above atmospheric. As emphasized in the aforesaid U.S. Pat. No. 4,088,424, however, such working air, which picks up by entrainment the residual liquid from a floor or other wet surface, is not completely freed of such liquid by gravity or by baffles and filters in the cleaning equipment before the working air enters the fan section 50. Thus, some of the residual cleaning liquid which remains entrained with working air passing through the fan section 50 is capable of collecting within that fan section and, if allowed to remain, would constitute a hazard to the life of the main bearing 40 supporting the shaft 15 that extends from the motor section 10 into the fan section 50.

Due largely to the detergent in such collected cleaning liquid, conventional bearing seals and the packing therefor can quickly become ineffective and permit (but for the bearing air-seal obtainable according to the aforesaid patent and the improved seal obtained by this invention), access to, and a consequent deteriorating attack upon, the lubricant of the main bearing. That is, the detergent in such collected cleaning liquid which does gain access to the main bearing can dissolve or suspend the lubricant for the bearing. With insufficient lubrication, the bearing can quickly fail in service; the soil carried by detergent can accelerate such failure. Operation of the unit after the main bearing has commenced to fail can lead to the damage of other elements of the unit, which damage may be permanent and irreparable or at least expensive due both to the cost of repairs and such "down-time" of the equipment as is required for repair of its motor-fan unit.

(a) Normal operation—air seal

The aforesaid patent discloses an air-seal for the main bearing of a motor-fan unit which is effected by a baffle-plate similar to the above described baffle plate 38 in that it provides a sealing air passageway leading from an ambient atmosphere inlet located radially outwardly from a motor section to a central opening in a fan section. The central opening in the prior baffle plate, however, has a diameter greater than the support ring for the main bearing. An air seal cup carried on the main shaft of the prior unit has an outer cylindrical surface of a lesser diameter than the central opening in the baffle plate. Inasmuch as the cup extends into said opening and over the protrusion from the fan-end bracket of the main bearing support ring, there is provided a narrow annular orifice through which dry ambient air is drawn from the passageway over the outer surface of the cup into a sealing air fan for discharge with the working air. The dry sealing air drawn through the annular orifice sweeps away with it any cleaning liquid which could otherwise collect around the main bearing.

This invention permits (but does not require) elimination of the air-seal cup extending over and substantially enshrouding a support ring for the main bearing, as employed in the above described air-seal of U.S. Pat. No. 4,088,424. By elimination of that element by means of a baffle plate differently contoured adjacent its central opening, this invention can obtain a more effective air-seal while permitting greater manufacturing tolerances. That is, in both the above described prior air-seal and the air-seal obtained by the invention, the effectiveness of the air seal is relatively proportional to the volume of air which is drawn from the air-seal passage and its velocity as it passes through the baffle plate opening into the eye of the sealing air fan. By off-setting the central portion of the baffle plate 38 so that it (the baffle plate), rather than an air-seal cup, substantially enshrouds the bearing support ring 41 and its retained main bearing 40, the diameter of the central opening 52 of the baffle plate 38 may be less. Accordingly, the total area of the annular orifice provided by the space between the central baffle plate opening 52 and the spacer 76 can also be less, despite the appreciably greater clearance between the periphery of the opening 52 (constituting the outside periphery of the annulus) and the periphery of the spacer 76 (constituting the inside periphery of the annulus). Thus, for a given quantity of sealing air drawn into the fan section of a unit, the smaller area of the annular orifice around the spacer 76 will cause such sealing air to move through the orifice at a greater velocity and, thereby, more effectively sweep away into working air being discharged from the fan chamber any cleaning liquid which otherwise accumulates at or near the orifice.

(b) Abnormal operations

(i) Escape of Cleaning Liquid from Fan Section; Prevention Thereof

For over-all compactness of assembled cleaning equipment employing a motor fan unit made according to this invention (or a prior art unit such as that disclosed in the aforesaid U.S. patent), the unit is usually mounted in or on the cleaning equipment so that the motor and fan shaft is vertical and the fan section is below the motor section. When so mounted, substantially all entrained liquid which might collect in the unit after the motor is stopped can usually drain out a working air inlet port, such as the port 62, before the motor is re-started. However, manufacturers of cleaning equipment are free to position a motor fan unit in other than the usual position and thereby possibly (but not necessarily) invite, in the intervals between uses of the equipment, the accumulation within a fan section of an appreciable amount of liquid which, when the fan motor is stopped, drops out of suspension in the working air remaining in the fan section.

The accumulation of unsuspended liquid within a fan section usually presents no problem when the motor is restarted, being re-entrained in new working air drawn into the fan section and discharged therefrom—unless the operator restarts or runs the motor under an abnormal condition, namely, when there is an obstruction or undue resistance to discharge from the fan section, such as, for example, that caused by an operator's carelessly permitting partial or complete blockage of the horn 35 or a kinking of a discharge hose, if one is attached to the horn 35. Under such conditions, especially in prior art motor-fan units in which motor-ventilating air is drawn into a fan chamber for discharge with working air, the working air driven by its fans will seek an outlet through such inlet for the motor ventilating air, whereby suspended liquid thus carried into the motor section could attack, from within the motor section, the motor bearing and conventional bearing seals or otherwise interfere with the operation of the motor.

Even a motor-fan unit as disclosed in the aforesaid U.S. patent, in which the inlet for the bearing sealing air is located radially outwardly of the motor section so that there is no direct access of the motor ventilating air to the fan section, if there is abnormal resistance to the discharge from the fan section of accumulated liquid with the new working air when the motor is restarted or, after the motor starts, such a resistance develops, the fans driving the incompletely dried working air may overpower the sealing air fan, forcing a reverse flow through the passageway and inlet for the sealing air. Especially if the motor fan unit is not mounted in the recommended position, liquid which escapes by reverse flow through the sealing air inlet can thereafter seep into the motor section and/or accumulate as soil on the exterior of the unit or the equipment on which the unit is mounted. The problems arising from reverse flow through the sealing air inlet due to resistance of discharge from the fan chamber could become particularly troublesome if the unit were mounted so that any overflow of the cleaning liquid normally retained in a receptacle in the cleaning equipment could enter into the fan chamber through the working air inlet. (Such overflow could be caused by malfunction of a drainage system of the cleaning equipment or a failure of the operator to empty the receptacle as it becomes filled). In such a case, but for the sealing air check valve, the working air fans could function as pumps for the overflow liquid and cause some of it to be discharged through the sealing air inlet.

In motor-fan units made according to this invention, under any of the above abnormal conditions, the check valve 47 prevents a reverse flow through the sealing air inlet 44.

(ii) Fan Protection

Another abnormal condition may arise when, due to malfunction elsewhere in the cleaning equipment in which the motor-fan unit is located, working air is shut off from entrance into the fan section. Under such a circumstance, i.e., with no working air available to be discharged, the working air fans will continue to be driven and rapidly churn the air remaining within the fan section. Even though the air remaining within the fan section is only at substantially atmospheric pressure, such rapid churning, but for the bearing sealing air, could quickly raise the remaining air to a temperature high enough to damage or even destroy (a) the rotating fans (due to warping and/or softening of their blades and/or supporting members) and/or (b) the main bearing for the motor and fan shaft (due to impairment or failure of lubrication). However, under the condition in which no working air is admitted into the fan chamber (or far less than the normal amount is admitted), the sealing air fan 63 is not over-powered but continues to draw sealing air at substantially atmospheric temperature through the inlet 44 to open the check valve 47 and permit entrance through the passageway 51 into the fan chamber 60. Such sealing air can be of a sufficient volume that it not only dilutes the volume and drops the temperature of the other air in the fan chamber to a safe temperature for all the fans but also permits a portion of such diluted air, though still heated, to be discharged through the horn 35.

The foregoing describes a preferred embodiment of the invention as shown in the accompanying drawings. This invention is not, however, limited to such embodiments but may be modified and varied within the scope of the appended claims without departing from the invention as defined in the appended claims. For example:

A two-stage fan system comprised of rotating fans 66 and 73 is shown for handling the working air. For motor-fan units which must handle larger volumes of working air relative to the amount of air required for the air seal of the main bearing 40, additional stages may be added as an alternative to simply increasing the size of the working air fans. Similarly, in some units a single-stage working air fan may be sufficient, in which case, the depth of the flange of the fan chamber casing 61 is simply decreased and the sub-casing 69 is omitted so that working air is led into the eye of such a single-stage working air fan by a port corresponding to the port 62 in the disclosed fan chamber casing 61.

Likewise, the disclosed sealing air fan 63 and the final stage (or sole) working air fan 66—since both back-to-back fans impel air radially outwardly from the shaft 15—may be combined into a single rotating fan provided with a suitable hub means permitting both sealing air (drawn from the central opening 52 in the baffle plate 38) and working air (drawn from a central port in the fan chamber casing) to be driven radially outwardly for discharge from the fan chamber 60.

Thus, as used in this specification and the following claims, the term "fan system", unless otherwise apparent from the context, comprehends not only a single fan functioning (as pointed out above) to impel both sealing air and working air but any combination of one or more working fans and one or more sealing air fans.

Similarly, pins, snap-rings, keys, or like conventional securing means other than the clamping means, such as the spacers 76 and 77 may be employed to mount the sealing air fan and the working air fan or fans on the shaft 15, whereby the spacer or bushing 76, or at least its portion extending axially through the baffle plate's central opening 52, may be eliminated so that the annular orifice through which sealing air sweeps from the passageway 51 into the fan chamber 60 is defined by the peripheries of the opening 52 and the shaft 15, per se, passing therethrough. Thus, unless otherwise apparent from the context of the following claims, the term "shaft" as used therein with relation to the central opening in the baffle plate is to be understood to include not only the shaft 15, per se, but also elements carried thereby as integral or separable elements such as a spacer 37 and/or an air-seal cup having an outer surface extending through such baffle plate opening and at least partly blocking the access of fluids from the fan chamber to the main bearing 40. It is also to be understood that, though only one sealing air inlet into the sealing air passageway is disclosed, a plurality may be employed, each preferably provided with a suitable check valve when an otherwise reverse flow of air through such an inlet might carry therethrough any liquid brought by the working air into the fan chamber.

What is claimed is:

1. In a fan section for a wet pick-up type vacuum cleaner unit comprised of a motor section and a fan section, said motor section containing a motor and means for causing motor-cooling air to be drawn into said motor section through an entrance thereto and discharged through an exit therefrom, said fan section having a fan chamber provided with an inlet port and containing a fan system which draws working air (by which cleaning and pick-up is performed) into said chamber through said inlet port and discharges the same through an outlet remote from an entrance or exit for the motor-cooling air of said motor section, said fan chamber having a wall provided with support means for a main bearing in which is journaled a shaft extending into said fan chamber and on which said fan system is mounted so as to provide a space between said bearing and the most closely adjacent fan of said fan system, said fan section having a sealing air inlet which is spaced from either a working air inlet or outlet of said fan section or a motor-cooling air entrance or exit of said motor section and which sealing air inlet leads through a sealing air passageway toward the location where said shaft extends from said bearing into said fan chamber, said passageway including a baffle portion segregating the passageway from the balance of said fan chamber and having an opening through which said shaft extends into said chamber, said opening being larger than the portion of said shaft passing therethrough to provide a substantially annular orifice through which sealing air, under normal operating conditions, may be drawn from said passageway into said fan chamber whereby liquid carried by said working air into said fan chamber and which might otherwise accumulate adjacent said bearing in the space between said bearing and the most adjacent fan is swept, by the sealing air passing through said orifice into said fan chamber, back into said fan chamber for discharge therefrom with said working air, the improvement comprising:

check valve means preventing reverse flow of air and liquid carried thereby through said orifice, passageway, and sealing air inlet under an abnormal condition in which, but for said check valve means, resistance to discharge of said working air from said fan section outlet would exceed the resistance of reverse flow through said orifice and passageway and out of said sealing air inlet.

2. In a fan section as defined in claim 1, the improvement comprising a plurality of inlets for sealing air which normally sweeps through said orifice into said fan chamber and check valve means for preventing reverse flow out of any of said sealing air inlets.

3. A fan section as defined in claim 1 in which said check valve is located in said passageway adjacent the normal exit of said sealing air inlet.

4. A fan section as defined in claim 3 in which said check valve means comprises a flexible member and means to fix the position of the same with respect to the exit of the sealing air inlet, said flexible member normally closing the exit of said sealing air inlet into said passageway but flexing to open said exit when, under normal operating conditions in which the atmospheric pressure within said inlet exceeds the air pressures in said passageway, sealing air passes to and through said orifice (a) to sweep liquid accumulated adjacent said orifice into working air discharged from said fan chamber and, under an abnormal condition in which the volume of working air entering said fan is insufficient to prevent the air within said fan chamber from being over-heated by the action of said fan system thereon, (b) to dilute and cool such working air and thereby cool said fan system.

5. A fan section as defined in claim 4 in which said flexible member has a domed configuration to provide a concave surface, facing toward the exit of said sealing air inlet, that terminates in a peripheral edge which, in the absence of flow from said sealing air inlet into said passageway, normally closes said sealing air inlet by contacting a surface surrounding the exit of said sealing air inlet but which, when air pressure on the concave surface is greater than the air pressure in said passageway, causes the member to flex and lift said edge to permit flow from said sealing air inlet into said passageway.

6. A fan section as defined in claim 5 in which the means to fix the said flexible member comprises a stub and socket connection by which said flexible member is held in said sealing air passageway by engagement with said baffle.

7. A fan section as defined in claim 5 in which, within the periphery of the surface contacted by the edge of said flexible member, said surface is depressed to provide a rim on which said edge is seated to effect normal closure of the sealing air inlet and to provide a larger volume beneath the concave surface of said flexible member to aid the lifting of substantially the entire periphery of said edge from said rim when the air pressure within said sealing air inlet exceeds the pressure within said passageway.

8. A fan section as defined in claim 1 in which said baffle portion of said passageway encloses the support means for said bearing to extend said passageway radially inwardly of the periphery of said support means and thereby locate said annular orifice within said space between said bearing and the most closely adjacent fan of said fan system.

9. A fan section as defined in claim 8 in which the diameter of said opening in said baffle is greater than the diameter of said shaft extending therethrough but less than the outer diameter of said main bearing in which said shaft is journaled.

10. A fan section as defined in claim 9 in which said support means in said bearing protrudes from said wall toward said fan chamber and said baffle is offset to permit said passageway to extend to said annular orifice.

11. A fan section as defined in claim 10 in which the portion of said shaft extending through said opening in said baffle carries a bushing spacing said bearing from the most closely adjacent portion of the fan system mounted on said shaft.

12. In a fan section for a wet pick-up type vacuum cleaner unit comprised of a motor section and a fan section, said motor section containing a motor and means for causing motor-cooling air to be drawn into said motor section through an entrance thereto and discharged through an exit therefrom, said fan section having a fan chamber provided with an inlet port and containing a fan system which draws working air (by which cleaning and pick-up is performed) into said chamber through said inlet port and discharges the same through an outlet remote from an entrance or exit for the motor-cooling air of said motor section, said fan chamber having a wall provided with support means for a main bearing in which is journaled a shaft extending into said fan chamber and on which said fan system is mounted so as to provide a space between said bearing and the most closely adjacent fan of said fan system, said fan section having a sealing air inlet which is spaced from either a working air inlet or outlet of said fan section or a motor-cooling air entrance or exit of said motor sections and which sealing air inlet leads through a sealing air passageway toward the location where said shaft extends from said bearing into said fan chamber, said passageway including a baffle portion segregating the passageway from the balance of said fan chamber and having an opening through which said shaft extends into said chamber, said opening being larger than the portion of said shaft passing therethrough to provide a substantially annular orifice through which sealing air, under normal operating conditions, may be drawn from said passageway into said fan chamber whereby liquid carried by said working air into said fan chamber and which might otherwise accumulate adjacent said bearing in the space between said bearing and the most adjacent fan is swept, by the sealing air passing through said orifice into said fan chamber, back into said fan chamber for discharge therefrom with said working air, the improvement in which:

said baffle portion of said passageway encloses the support means for said bearing to extend said passageway radially inwardly of the periphery of said support means and thereby locate said annular orifice within said space between said bearing and the most closely adjacent fan of said fan system.

13. A fan section as defined in claim 12 in which the diameter of said opening in said baffle is greater than the diameter of said shaft extending therethrough but less than the outer diameter of said main bearing in which said shaft is journaled.

14. A fan section as defined in claim 13 in which said support means in said bearing protrudes from said wall toward said fan chamber and said baffle is offset to permit said passageway to extend to said annular orifice.

15. A fan section as defined in claim 14 in which the portion of said shaft extending through said opening in said baffle carries a bushing spacing said bearing from the most closely adjacent portion of the fan system mounted on said shaft.

* * * * *

REEXAMINATION CERTIFICATE (820th)

United States Patent [19] [11] B1 4,226,575

Hyatt et al. [45] Certificate Issued Mar. 8, 1988

[54] WET PICK-UP VACUUM UNIT

[75] Inventors: Robert L. Hyatt, Tallmadge; Norbert H. Niessner, South Euclid; Richard D. Sumser, Louisville, all of Ohio

[73] Assignee: Ametek, Inc., Kent, Ohio

Reexamination Request:
No. 90/000,840, Aug. 20, 1985

Reexamination Certificate for:

| | |
|---|---|
| Patent No.: | **4,226,575** |
| Issued: | **Oct. 7, 1980** |
| Appl. No.: | **46,007** |
| Filed: | **Jun. 6, 1979** |

[51] Int. Cl.[4] ..... F04B 37/20

[52] U.S. Cl. ..... 417/423 A; 415/112; 417/368

[56] References Cited

U.S. PATENT DOCUMENTS

| | | | |
|---|---|---|---|
| Re. 32,027 | 11/1985 | Hyatt et al. | 417/423 A |
| 1,375,595 | 4/1921 | Lamontagne . | |
| 2,172,135 | 9/1939 | Breuer . | |
| 2,422,968 | 6/1947 | Jason | 417/423 A |
| 2,430,047 | 11/1947 | Edberg . | |
| 2,534,808 | 12/1950 | Bevington, Jr. et al. . | |
| 2,665,059 | 1/1954 | Newton . | |
| 2,990,105 | 6/1961 | Van Rijn . | |
| 3,228,342 | 1/1966 | Page . | |

OTHER PUBLICATIONS

Canadian Standard Association Publication C22.2, No. 67-M1985, dated Feb., 1985.

*Primary Examiner*—Carlton R. Croyle

[57] ABSTRACT

A motor-fan unit for a wet pick-up type of vacuum cleaner comprising a fan-section and a separately ventilated motor section. A motor-end bracket in the motor housing structure serves as a common end wall with the fan section and carries a bearing for the common shaft of the motor and fan. A baffle carried by the motor-end bracket within the fan section has an apertured central portion, at least partly enclosing the bearing, to provide a passage-way for high velocity air sealing the bearing from detergent-containing cleaning liquid entrained in working air drawn into the fan section. A normally closed check valve at an inlet to the sealing air passage-way inhibits back-flow of either air or liquid through the inlet but permits such sealing air to serve as cooling air when the entrance of working air into the fan section is impeded.

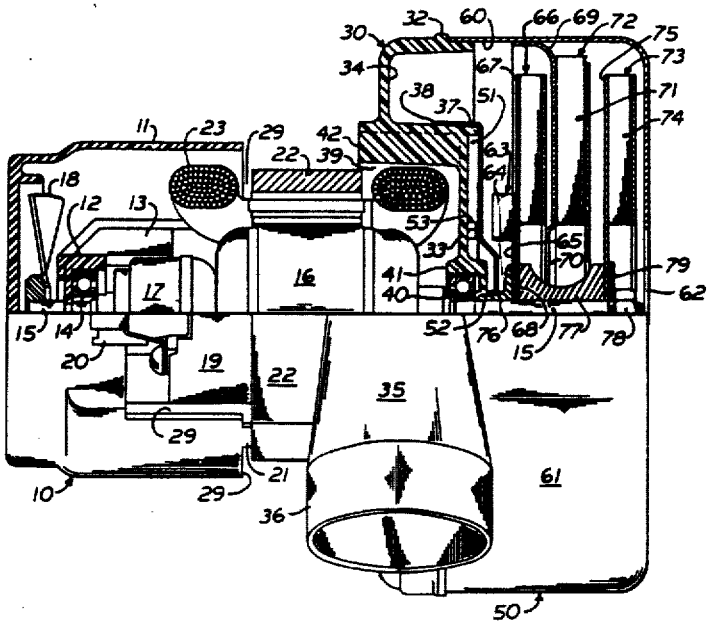

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–11 are confirmed.

Claims 12–15 are cancelled.

* * * * *